US007789528B2

(12) United States Patent
Mo et al.

(10) Patent No.: US 7,789,528 B2
(45) Date of Patent: Sep. 7, 2010

(54) OUTDOOR LED LAMP HAVING A PROTECTIVE COVER

(75) Inventors: Ci-Jin Mo, Shenzhen (CN); Li He, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 221 days.

(21) Appl. No.: 12/202,405

(22) Filed: Sep. 1, 2008

(65) Prior Publication Data

US 2009/0316404 A1 Dec. 24, 2009

(30) Foreign Application Priority Data

Jun. 18, 2008 (CN) ..... 2008 1 0067913

(51) Int. Cl.
*F21S 4/00* (2006.01)

(52) U.S. Cl. ..... 362/249.02; 362/373

(58) Field of Classification Search ..... 362/249.02, 362/249.01, 373, 431
See application file for complete search history.

(56) References Cited

U.S. PATENT DOCUMENTS

| | | | | |
|---|---|---|---|---|
| 7,278,761 | B2 * | 10/2007 | Kuan | 362/373 |
| 7,420,811 | B2 * | 9/2008 | Chan | 362/373 |
| D603,087 | S * | 10/2009 | Mo et al. | D26/119 |
| 2009/0237931 | A1 * | 9/2009 | Liu et al. | 362/373 |
| 2009/0268477 | A1 * | 10/2009 | Zheng et al. | 362/373 |

* cited by examiner

*Primary Examiner*—David V Bruce
(74) *Attorney, Agent, or Firm*—Frank R. Niranjan

(57) ABSTRACT

An outdoor LED lamp includes an LED lamp and a cover mounted on the LED lamp and covering a heat sink of the LED lamp therein. The LED lamp includes a bracket, the heat sink mounted on a top side of the bracket, and a plurality of LED modules mounted on a bottom surface of the heat sink. The cover is a bended metal sheet. The cover includes a covering portion located over a top of the heat sink and a baffling portion extending slantwise downwardly from an end of the covering portion. Height of the covering portion is decreased from a central portion to opposite lateral portions of the covering portion. Slits are defined in the covering portion. Downwardly opened slots are defined in the baffling portion. The cover is used for preventing snow, leaves or dust from accumulating on the heat sink.

13 Claims, 4 Drawing Sheets

OUTDOOR LED LAMP HAVING A PROTECTIVE COVER

BACKGROUND OF THE INVENTION

1. Field of the Invention

The present invention relates to an outdoor LED lamp, more particularly to an outdoor LED lamp having a cover mounted thereon to prevent snow or dust from accumulating on the outdoor LED lamp.

2. Description of Related Art

A conventional outdoor LED lamp comprises a heat sink and a plurality of LED modules having LEDs attached to a bottom surface of the heat sink. When the outdoor LED lamp works for a long time, foreign articles such as dust, snow or leaves may be accumulated on the heat sink. The accumulated foreign articles on the heat sink of the outdoor LED lamp can severely affect the normal function of the lamp.

What is needed, therefore, is an outdoor LED lamp having a cover mounted thereon to prevent accumulation of foreign articles on a heat sink of the outdoor LED lamp.

SUMMARY OF THE INVENTION

An outdoor LED lamp includes an LED lamp and a cover mounted on the LED lamp and covering heat sinks of the LED lamp therein. The LED lamp includes a bracket, the heat sinks mounted on a top side of the bracket, and a plurality of LED modules mounted on a bottom surface of the heat sinks. The cover is a bended metal sheet. The cover includes a covering portion located over a top of the heat sinks and a baffling portion extending slantwise downwardly from an end of the covering portion. Height of the covering portion is decreased from a central portion to opposite lateral portions of the covering portion. Slits with small width are defined in the covering portion. Downwardly opened slots are defined in the baffling portion. The covering portion spaces from the heat sinks with a sufficient space so that heat in the heat sinks can be effectively removed therefrom.

Other advantages and novel features will become more apparent from the following detailed description of preferred embodiments when taken in conjunction with the accompanying drawings.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
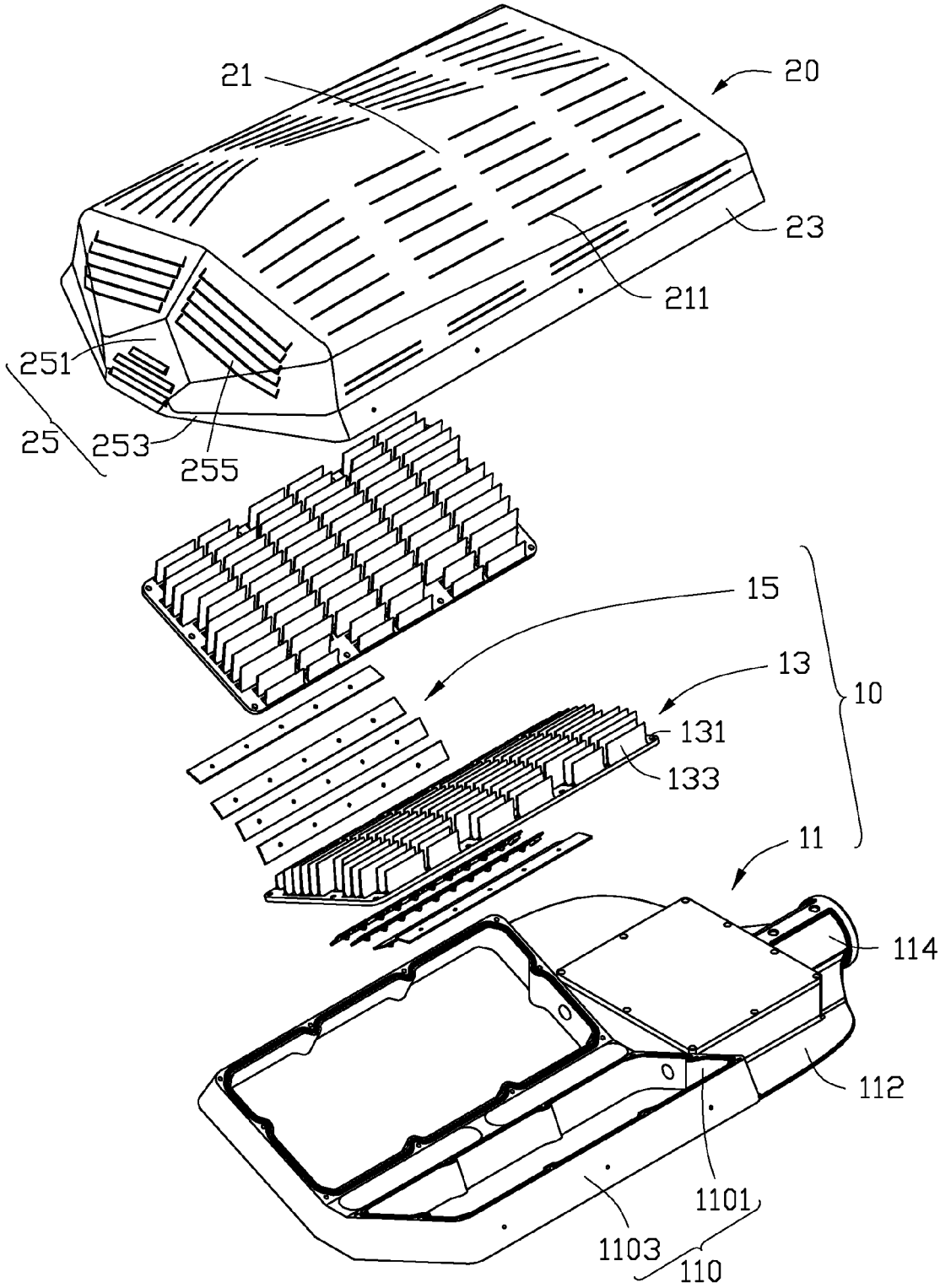
FIG. 1 is an exploded view of an outdoor LED lamp in accordance with a preferred embodiment of the present invention.
Figure 2:
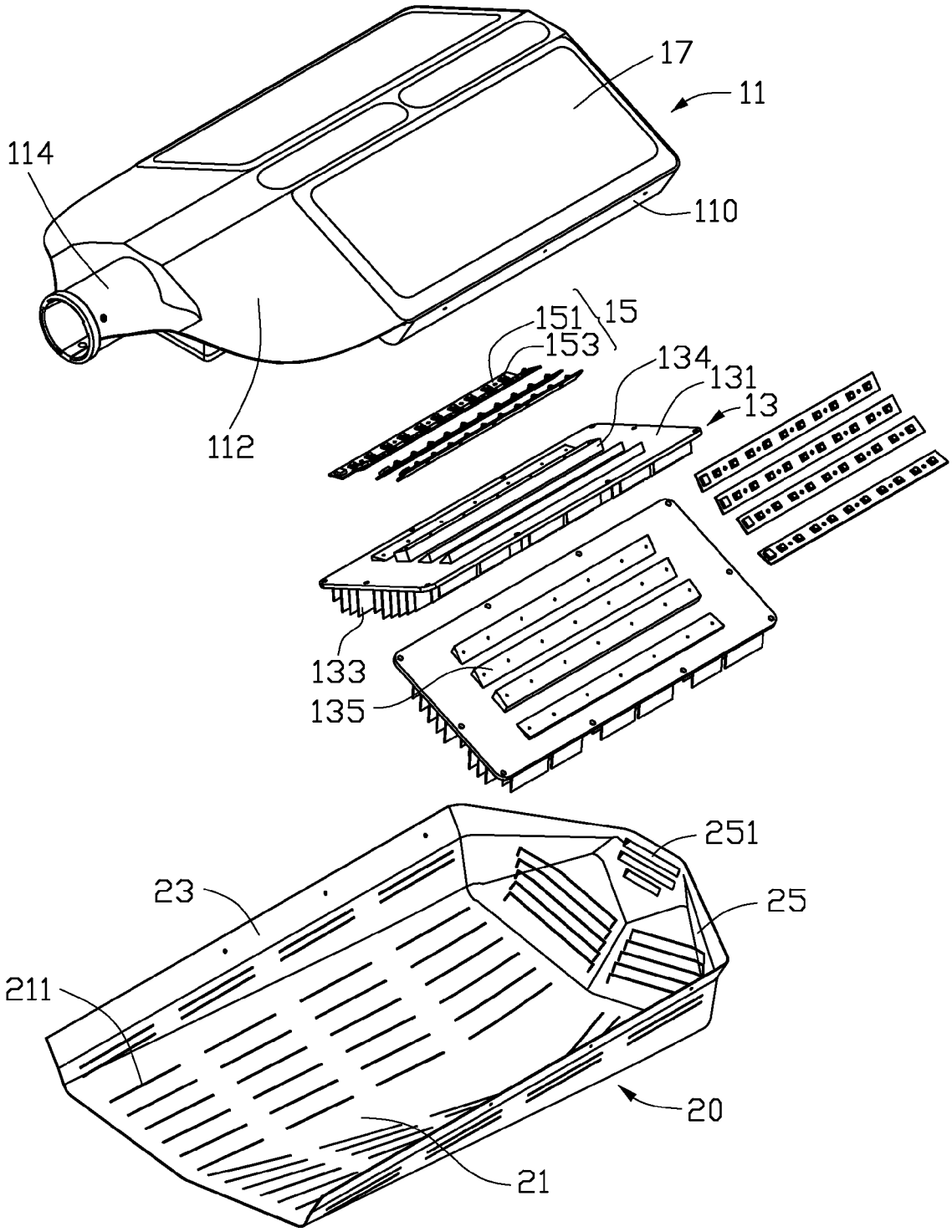
FIG. 2 is an inverted view of FIG. 1.

Referring to FIGS. 1-2, an outdoor LED lamp comprises an LED lamp 10 and a cover 20 mounted on the LED lamp 10 to cover two heat sinks 13 of the LED lamp 10 therein. The LED lamp 10 comprises a bracket 11, the two heat sinks 13 mounted on a top side of the bracket 11, a plurality of LED modules 15 mounted on bottom surfaces of the heat sinks 13, and a pair of transparent envelopes 17 mounted on a bottom side of the bracket 11.

Figure 3:
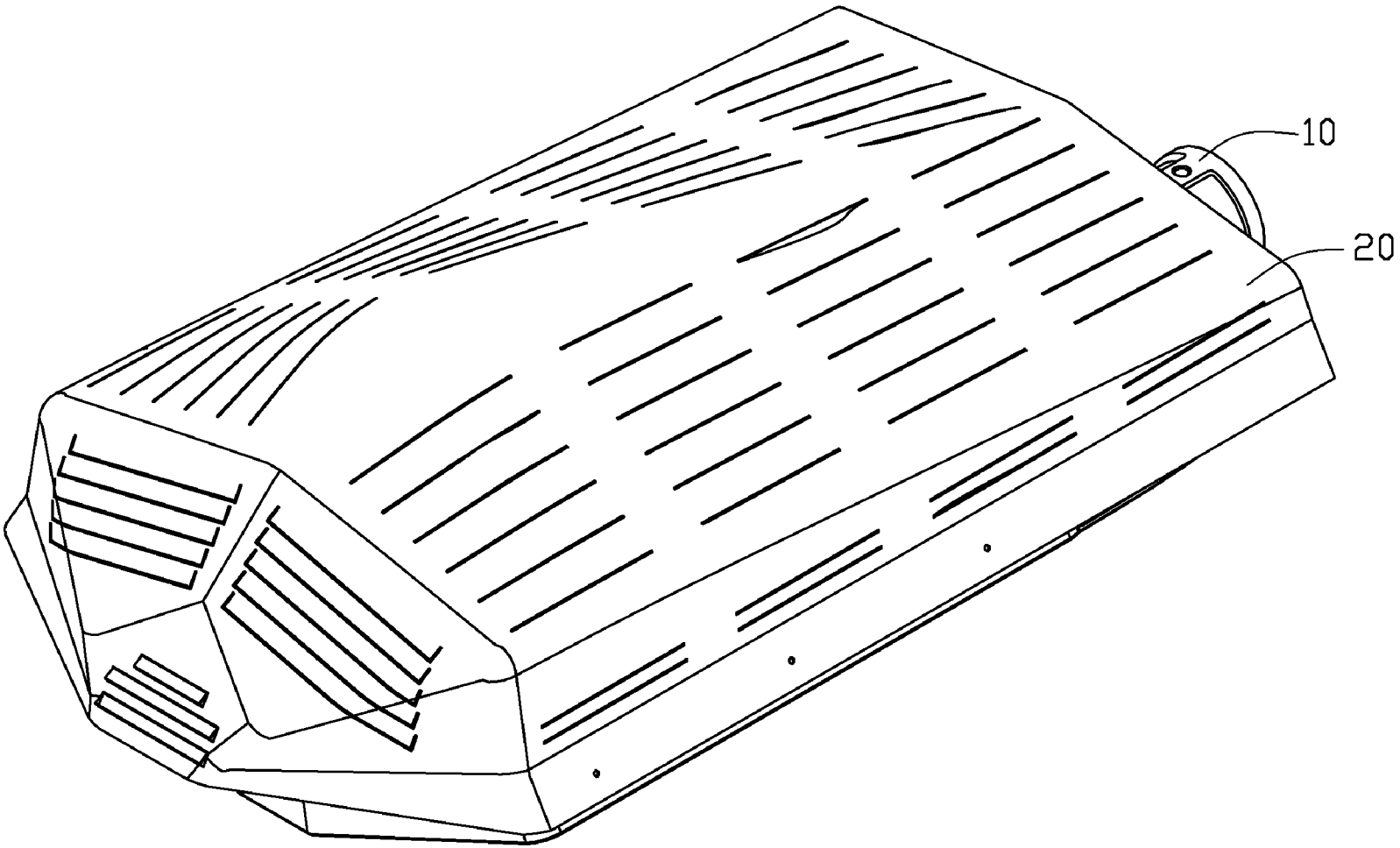
FIG. 3 is an assembled view of FIG. 1.
Figure 4:
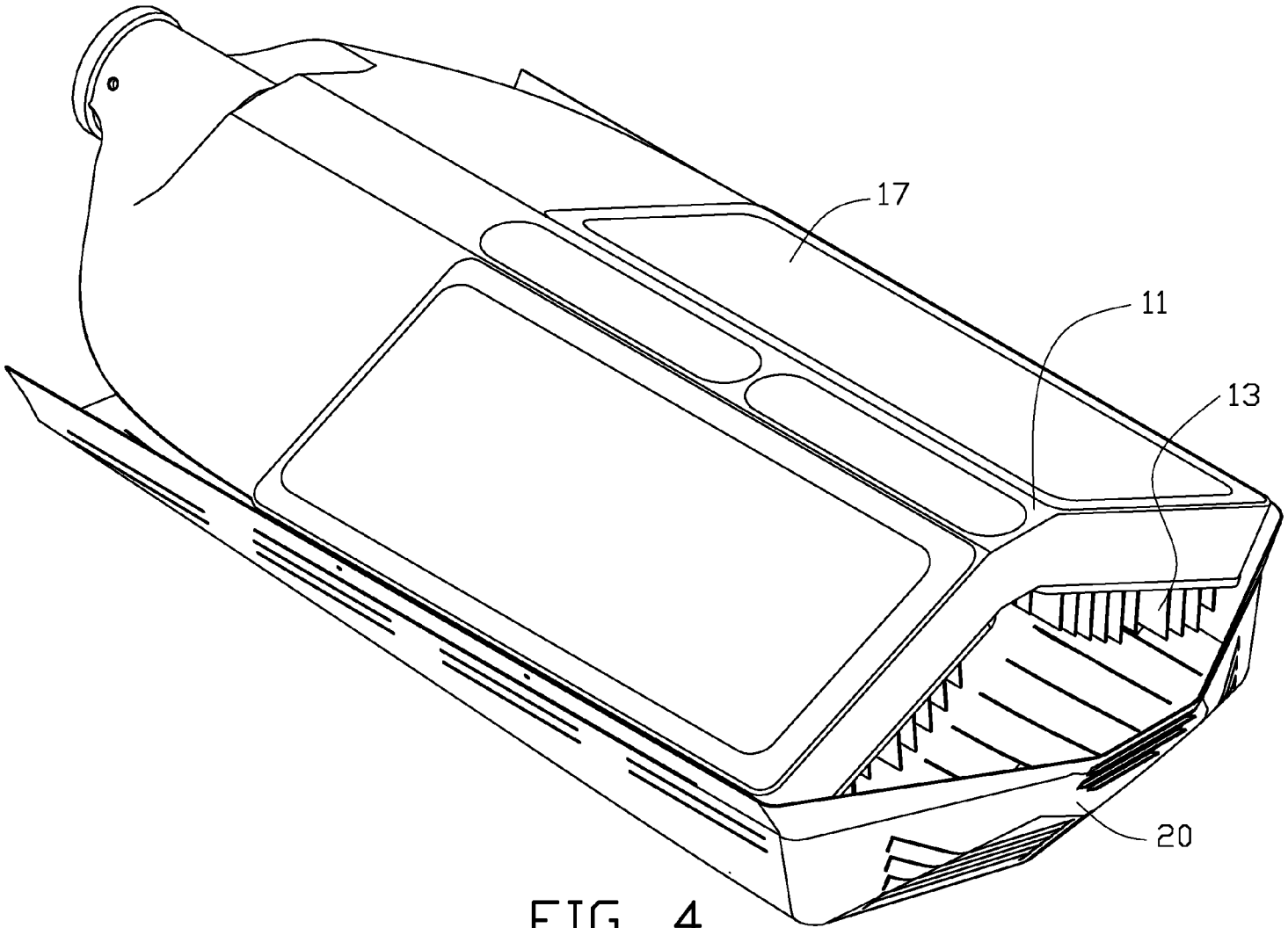
FIG. 4 is an assembled view of FIG. 1, but shown from another aspect.

Referring to FIGS. 3-4 also, the bracket 11 is alary and comprises two frames 110 interconnected with each other, and a receiving member 112 located at a right end of the frames 110. Each of the frames 110 has a substantially rectangular configuration, and comprises two pairs of elongated sidewalls 1101, 1103 interconnected with each other. The two frames 110 connect with each other via two adjacent sidewalls 1103 in such a manner that the two sidewalls 1103 act as two opposite sides of a central beam (not labeled) which is located at a center of the two frames 110. Other part of the two frames 10 except the adjacent sidewalls 1103 extend outwardly and upwardly relative to the adjacent sidewalls 1103 to form an alary configuration. The two heat sinks 13, the frames 110 and the envelopes 17 are assembled together to form two hermetical chambers (not labeled) receiving the LED modules 15 therein. A driving circuit module (not shown) is received in the receiving member 112 for electronically connecting with the LED modules 15. A fixture 114 extends outwardly from a center of an end of the receiving member 112. The fixture 114 is used for connecting the LED lamp 10 to a supporting structure, such as a supporting post (not shown) of a lamp stand (not shown).

Each heat sink 13 is made of copper or aluminum. The heat sink 13 comprises an elongated base 131. A plurality of screws (not shown) extends through edges of the base 131 and engages with the sidewalls 1101, 1103 of the frame 110 to mount the heat sink 13 on the frame 110. Four elongated mounting members 134 are spaced from each other and extend downwardly from a bottom surface of the base 131. Each mounting member 134 has a planar mounting surface 135. The LED modules 15 are mounted on the mounting surfaces 135. The mounting surfaces 135 are angled with each other. Three of the mounting surfaces 135 located at an inner side of each of the frames 110 orient towards an outer side of each of the frames 110. The three mounting surfaces 135 and the bottom surface of the base 131 form acute angles which are decreased from the inner side to an outer side of the frame 110 along a transverse direction of the base 131; in this manner, the LED modules 15 on the mounting surfaces 135 are oriented to different directions. Thus, the outdoor LED lamp has a large illumination angle than the conventional LED lamp. The outermost mounting surface 135 slantwise orients towards the inner side of the frame 110. Thus, light emitted from the LED modules 15 are evenly distributed. A plurality of fins 133 is formed on the top surface of the base 131.

Each LED module 15 comprises an elongated printed circuit board 151 and a plurality of spaced LEDs 153 evenly mounted on a bottom side of the printed circuit board 151. The LEDs 153 of each LED module 15 are arranged along a longitudinal direction of the printed circuit board 151. The LED modules 15 are in a thermally conductive relationship with the mounting surfaces 135 of the mounting members 134 of the bases 131 of the heat sinks 13.

Each of the envelopes 17 is transparent. A plurality of screws (not shown) extends through the envelopes 17 and engages with the frame 110 to mount the envelopes 17 on the frame 110.

The cover 20 is a bended metal sheet and mounted to the frames 110 of the bracket 14 to cover the heat sinks 13 of the LED lamp 10 therein. The cover 20 comprises a covering portion 21 located over a top of the heat sinks 13, a pair of mounting portions 23 extending from opposite edges of the covering portion 21, and a baffling portion 25 extending slantwise and downwardly from a left end of the covering portion 21. Each of the mounting portions 23 is an elongated plate and contacts with the sidewall 1103 of a corresponding frame 110. A plurality of screws (not shown) extends through the mounting portions 23 and engages with the sidewalls 1103 of the frames 10 to mount the cover 20 on the frames 110. The covering portion 21 is an arc-shaped metal sheet. Height of the left end of the covering portion 21 is decreased from a central portion to front and rear portions (not labeled) which are located at opposite sides of the central portion. The central portion of the covering portion 21 and the front portion or rear portion form an angle varied between 5° and 10°. Thus, the foreign articles, for example, snow, dust or leaves accumulated on the cover 20 are prone to drop from the cover 20 from the front and rear portions thereof. Height of the covering portion 21 is decreased from the left end to a right end. The covering portion 21 is spaced from the heat sinks 13. Thus, airflow can flow in the covering portion 21 through the fins 133 to take heat away from the heat sinks 13 and accordingly the LEDs 153 of the LED lamp 10. A plurality of slits 211 is defined in the covering portion 21. Thus, the airflow heated by the heat sinks 13 of the LED lamp 10 can leave the covering portion 21 via the slits 211. The baffling portion 25 covers a left end of the LED lamp 10. The baffling portion 25 comprises a central portion 251 extending slantwise and downwardly from a left edge of the covering portion 21 and a pair of flanges 253 extending slantwise from left edges of the mounting portions 23 and connecting with edges of the central portion 251. Height of the central portion 251 of the baffling portion 25 is decreased from a center to front and rear sides thereof. Thus, the foreign articles on the baffling portion 25 is prone to drop form the baffling portion 25. The flanges 253 of the baffling portion 25 extend outwardly and upwardly from the edges of the central portion 251 to prevent the foreign articles from entering the cover 20. A plurality of shutter-type slots 255 is defined in the baffling portion 25. Thus, airflow enters into the cover 20 from the slots 255 to cool the LED lamp 10. The slots 255 are opened downwardly. Furthermore, the slits 211 each have a small width whereby most of the foreign articles are prevented from entering the cover 20 through the slots 255 and slits 211. In addition, after a period of use, the cover 20 can be removed to clean the heat sinks 13 so that the heat sinks 13 can have an optimal heat dissipation effectiveness.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An outdoor LED lamp comprising:

a bracket;

a heat sink mounted on a top side of the bracket;

a plurality of LED modules mounted on a bottom surface of the heat sink; and a cover mounted on the bracket and covering the heat sink therein;

wherein the cover is a bended metal sheet and comprises a covering portion located over a top of the heat sink and a baffling portion extending slantwise downwardly from an end of the covering portion, and a height of the covering portion decreases from a central portion to opposite lateral portions of the covering portion.

2. The outdoor LED lamp as claimed in claim 1, wherein the baffling portion comprises a central portion extending slantwise and downwardly from the end of the covering portion, a height of the central portion of the baffling portion decreasing from a center to opposite sides thereof.

3. The outdoor LED lamp as claimed in claim 2, wherein the baffling portion comprises a pair of flanges extending upwardly and outwardly from edges of the central portion.

4. The outdoor LED lamp as claimed in claim 2, wherein the central portion of the baffling portion defines a plurality of shutter-type slots opened downwardly.

5. The outdoor LED lamp as claimed in claim 1, wherein the central portion and the lateral portions of the cover form an angle varied between 5° and 10°.

6. The outdoor LED lamp as claimed in claim 1, wherein a plurality of slits is defined in the covering portion.

7. The outdoor LED lamp as claimed in claim 1, wherein a height of the covering portion decreases from the end connected with the baffling portion to another end away from the baffling portion.

8. The outdoor LED lamp as claimed in claim 6, wherein the covering portion is spaced from the heat sink.

9. The outdoor LED lamp as claimed in claim 1, wherein the cover further comprises a pair of mounting portions extending downwardly from edges of the covering portion and connecting with the bracket.

10. The outdoor LED lamp as claimed in claim 1, wherein the heat sink comprises a base, a plurality of mounting members extends downwardly from a bottom surface of the base, each of the mounting members having a planar mounting surface, the LED modules being mounted on the mounting surfaces.

11. The outdoor LED lamp as claimed in claim 10, wherein some of the mounting surfaces of the mounting members which are located at an inner side of the bracket are oriented towards an outer side of the bracket.

12. The outdoor LED lamp as claimed in claim 11, wherein the some of the mounting surfaces of the mounting members and the bottom surface of the base form acute angles which are decreased along a transverse direction of the base from the inner side of the bracket towards the outer side of the bracket.

13. The outdoor LED lamp as claimed in claim 11, wherein the mounting surface of an outermost one of the mounting members is slantwise oriented towards the inner side of the bracket.

* * * * *